US008596493B2

(12) United States Patent
Vollers et al.

(10) Patent No.: US 8,596,493 B2
(45) Date of Patent: Dec. 3, 2013

(54) SAFETY CLOSURE WITH LOCK, AND ATTACHMENT SYSTEM FOR SAFETY CLOSURE

(75) Inventors: Claudio Patrick Vollers, Rio de Janeiro (BR); Jefferson Luiz Miranda Araújo, Rio de Janeiro (BR)

(73) Assignee: Fechamentos Inteligentes Desenvolvimento de Embalagens Ltda, Rio de Janeiro (BR)

( * ) Notice: Subject to any disclaimer, the term of this patent is extended or adjusted under 35 U.S.C. 154(b) by 0 days.

(21) Appl. No.: 13/505,084

(22) PCT Filed: Oct. 13, 2010

(86) PCT No.: PCT/BR2010/000333

§ 371 (c)(1),
(2), (4) Date: Apr. 30, 2012

(87) PCT Pub. No.: WO2011/050429

PCT Pub. Date: May 5, 2011

(65) Prior Publication Data

US 2012/0211505 A1 Aug. 23, 2012

(30) Foreign Application Priority Data

Oct. 30, 2009 (BR) ..... 0904284

(51) Int. Cl.
*B65D 45/16* (2006.01)
*B65D 55/02* (2006.01)

(52) U.S. Cl.
USPC ..... 220/833; 222/153.01; 220/324; 215/211

(58) Field of Classification Search
USPC ..... 222/556, 562, 563, 153.01, 153.04, 222/153.14; 220/839, 837, 324, 259.1, 833; 215/235, 237, 216, 217, 211, 252, 329
See application file for complete search history.

(56) References Cited

U.S. PATENT DOCUMENTS 3,713,247 A 1/1973 Parrilla
4,022,352 A 5/1977 Pehr (Continued)

FOREIGN PATENT DOCUMENTS

BR 9802607 6/2005
BR PI0802245-3 A2 9/2009

(Continued)

OTHER PUBLICATIONS

International Search Report for Appln. No. PCT/BR2010/000333 mailed Feb. 17, 2011.

(Continued)

*Primary Examiner* — J. Gregory Pickett
*Assistant Examiner* — Javier A Pagan
(74) *Attorney, Agent, or Firm* — Carter, DeLuca, Farrell & Schmidt LLP

(57) ABSTRACT

A safety closure secured against accidental opening or opening by small children comprises a lid and a cap interconnected by a hinge made of a single piece and having a single wall, the lid having a lateral skirt, a top surface with a pouring opening and an outer lateral grip that delimits a slot for engagement with the lock provided in the cap. The continuous lateral skirt has an internal thread, and a flap or ring is provided at the lower edge of the skirt for attaching the lid to the neck of a container. The inwardly extending flap secures the lid against axial movement when the lid is rotated in order to unscrew it. The cap has a sealing plug that closes the pouring opening and an external flap from which a locking body protrudes, the locking body having a central cutout that forms a spring blade that extends outwards from the locking body.

5 Claims, 3 Drawing Sheets

(56) References Cited

U.S. PATENT DOCUMENTS

| | | | | |
|---|---|---|---|---|
| 4,170,315 | A | | 10/1979 | Dubach et al. |
| 4,202,456 | A | | 5/1980 | Silber |
| 4,236,653 | A | | 12/1980 | Gach |
| 4,244,495 | A | | 1/1981 | Lorscheid et al. |
| 4,334,639 | A | | 6/1982 | Gach |
| 4,429,800 | A | | 2/1984 | Greenspan |
| 4,723,669 | A | | 2/1988 | Barriac |
| 4,759,455 | A | | 7/1988 | Wilson |
| 4,776,475 | A | | 10/1988 | La Vange |
| 4,892,208 | A | * | 1/1990 | Sledge ..... 215/216 |
| 4,940,167 | A | * | 7/1990 | Fillmore et al. ..... 222/153.09 |
| 4,964,833 | A | | 10/1990 | Suzuki |
| 4,974,735 | A | | 12/1990 | Newell et al. |
| 5,031,784 | A | | 7/1991 | Wright |
| 5,328,058 | A | | 7/1994 | Leoncavallo et al. |
| 5,356,017 | A | | 10/1994 | Rohr et al. |
| 5,361,919 | A | | 11/1994 | Hull et al. |
| 5,484,070 | A | | 1/1996 | Graham |
| 5,579,957 | A | | 12/1996 | Gentile et al. |
| 5,853,093 | A | | 12/1998 | Neiger |
| 5,967,384 | A | | 10/1999 | Mengeu et al. |
| 6,050,044 | A | | 4/2000 | McIntosh |
| 6,234,334 | B1 | | 5/2001 | Suarez |
| 6,296,541 | B1 | | 10/2001 | Bezalel et al. |
| 6,299,005 | B1 | | 10/2001 | Higgins |
| 6,382,476 | B1 | | 5/2002 | Randall et al. |
| 6,702,642 | B1 | | 3/2004 | Parein |
| 6,772,902 | B1 | | 8/2004 | White |
| 6,976,607 | B2 | | 12/2005 | Benoit-Gonin et al. |
| 7,404,495 | B2 | | 7/2008 | Keung |
| 7,654,411 | B2 | | 2/2010 | Boots et al. |
| 7,735,665 | B2 | | 6/2010 | Robinson |
| 7,832,577 | B2 | * | 11/2010 | Shingle et al. ..... 215/217 |
| 8,187,050 | B1 | | 5/2012 | Sorenson |
| 8,292,101 | B1 | | 10/2012 | Bragg et al. |
| 8,308,022 | B2 | * | 11/2012 | Barre et al. ..... 220/847 |
| 2005/0205607 | A1 | | 9/2005 | Hierzer et al. |
| 2006/0186078 | A1 | | 8/2006 | Ziegenhorn |
| 2008/0110933 | A1 | | 5/2008 | Goncalves |
| 2008/0169261 | A1 | | 7/2008 | Druitt et al. |
| 2010/0102020 | A1 | | 4/2010 | Sebille et al. |
| 2011/0139745 | A1 | | 6/2011 | Ezra et al. |
| 2012/0211460 | A1 | | 8/2012 | Tamarindo |

FOREIGN PATENT DOCUMENTS

| | | | |
|---|---|---|---|
| CN | 2571697 | Y | 9/2003 |
| CN | 2706417 | Y | 6/2005 |
| CN | 202046587 | U | 11/2011 |
| DE | 8003690 | | 5/1980 |
| DE | 3625477 | A1 | 2/1988 |
| EP | 0763478 | A1 | 3/1997 |
| FR | 2336956 | A1 | 7/1977 |
| GB | 2410493 | A | 8/2005 |
| IL | 41948 | A | 1/1977 |
| WO | 99/36332 | A1 | 7/1999 |
| WO | 9967151 | A | 12/1999 |
| WO | 0041791 | A1 | 7/2000 |
| WO | 0055063 | A1 | 9/2000 |
| WO | 0205918 | A1 | 1/2002 |
| WO | 2011/153598 | A1 | 12/2011 |

OTHER PUBLICATIONS

International Search Report issued in corresponding patent application No. PCT/BR2011/000148 mailed Aug. 16, 2011.

* cited by examiner

SAFETY CLOSURE WITH LOCK, AND ATTACHMENT SYSTEM FOR SAFETY CLOSURE

CROSS-REFERENCE TO RELATED APPLICATIONS

This application is a U.S. National Stage Application filed under 35 U.S.C. §371(a) of International Application No. PCT/BR2010/000333, filed Oct. 30, 2010, which claims the benefit of and priority to Brazil Application PI0904284-9 filed Oct. 30, 2009, the entire contents of which are incorporated by reference herein.

TECHNICAL FIELD

The present invention deals with a safety closure, more particularly a closure of fliptop type and its attachment system.

BACKGROUND

Packages with hinged closures of fliptop type are widely used in commerce for various purposes, each application having specific needs of easy handling and safety.

The principal factors to be considered in safety closures of fliptop type are resistance to unauthorized opening and resistance to an undesired, accidental opening.

Certain closures are known, considered to be child-resistant, which involve various pieces, camouflage, and movements that are so complex that their opening requires a high degree of specialization, not consistent with the average user, and undesirable in emergency situations.

The hinged fliptop closures of the prior art have inconveniences as to their handling and/or production cost.

The design of hinged closures with locks is already part of the prior art.

In the known designs there are some which present the lock projecting from the lid with the locking effectuated on the cap, or designed as an integral part of the cap with the locking at the lid.

The known closures have complicated designs, with double walls, being difficult to handle and with an elevated cost of raw material.

In some known fliptop closures with the lock designed as an integral part of the cap, the locking occurs internally, in the top of the lid, while the lock is released by applying pressure in an outer region corresponding to the location of the tip of the lock.

Since the lock is hidden on the cap, this design has the inconvenience of its opening not being intuitive, requiring an indication of the location to be pressed upon, in addition to requiring a design with double wall to avoid contact of the lock with the contents of the container.

In another type of known design, the lock is external to the cap and engages with a flange at the edge of the lid to snap in place. This closure presents the inconvenience of being hard to handle, being unlocked by the user's fingernail, and on the other hand it does not offer safety against accidental opening which might occur as a result of any slight deformation of the body of the lid or the cap.

A specific situation in which the deformation of the closure of the container might occur and accidentally release the contents is the transporting of a container with the aforementioned fliptop closure inside a woman's purse. In this case, with the forces experienced by the purse, or by the pressure of other objects contained therein, a deformation of the closure and an unwanted opening might occur.

Another type of fliptop closure in the prior art has an external lock that is inserted into a grip. The lock is hinged to the side of the lid and the grip is arranged externally on the cap.

In this case, as in other similar situations, the opening occurs by pressing forward the lock as a whole, in the direction of the side of the lid, releasing the lock. This design in particular has no obstacle to being opened by a child, and any movement or pressure that displaces the lock slightly will result in releasing the cap, allowing the contents to be spilled out.

Another aspect to be considered in safety closures is the attachment of the lid to the neck of the container in permanent manner.

The lid with the safety closure has to be attached in the neck of the container and be prevented from removal by unscrewing or any other means, there being commonly used for this purpose a screw combined with a ratchet which prevents turning in the direction of unscrewing. This system is effective, but it makes it necessary to adapt the container, providing it with teeth to cooperate with the ratchet of the lid.

Another inconvenience involves the expense of raw material to make the ratchet on the lid, increasing the cost of production. The quantity of raw material expended for the construction of the ratchet on the lid when thousands of units are involved is substantial, increasing the production cost.

SUMMARY

One purpose of the present invention is to provide a child-resistant safety closure with a system of opening that requires skill and dexterity, while being intuitive and easy to handle.

Another purpose of the present invention is a safety closure resistant to accidental opening of the cap.

The present invention also involves a safety closure, and the closure itself, where the hinged closure includes an external lock provided on the edge of the cap and an external retention grip at the edge of the lid, and it is associated with the permanent attachment of the lid in the neck of the container, resulting in a simple assembly, efficient in terms of safety and with reduced cost owing to economization of raw material.

The closure design of the present invention presents a lock design that makes all the difference, the opening of the cap requiring a skill that employs fine motor development, that is, control of fine movements, thereby creating a resistance to opening of the cap by one not having this developed skill, such as small children, and also resisting an accidental opening.

For opening of the cap in the closure of the present invention it is not enough to push the lock forward, as is the case with a conventional lock. Here, the element for the releasing is reduced to only part of the lock, a spring blade at the center of the lock, which has to be displaced forward, even with the retention grip, until it encounters the slot, and then pushes the lock upward and releases the cap.

The fliptop closure according to the present invention is secure against accidental opening, since the lock is arranged in the slot and is only released when pressure is applied in a specific location of the lock, that is, the upper part of the spring blade, and then being pushed upward, not enabling a release by a possible deformation of the body of the closure, or by the forward displacement of the main body of the lock.

According to the design of the present invention, the lock is constructed with a central spring blade, and in order to release the lock it is necessary for the blade to close on the body of the lock itself, which is fitted in the slot of the grip.

The reduction in raw material is achieved by the design of the closure with single walls, with the cutout in the lock for the construction of the spring blade, and by the system of attachment of the lock in the neck according to the present invention.

Closures with single walls have excited much interest by having a reduced production cost.

Thus, the present invention deals with a safety closure design that has a lock, properly speaking, secured in the neck of a container having a cap articulated by means of a hinge. The cap has a lock extending from a flap at its edge, in a position diametrically opposite the articulation element, that is, the hinge. The lock has a cutout in its central region that extends outwardly, forming a spring blade.

The lid has on its outside a grip with a slot for insertion of the lock by the spring blade.

Another purpose of the present invention is a system of attachment of the safety closure in the neck of the container that does not require any adapting of the container, making use of the flange present in the majority of necks.

The system of attachment of the lid is characterized by allowing a counterturning of the lid, turning idle in the unscrewing direction, without allowing an axial displacement.

The system of attachment of the safety closure according to the present invention combines the thread fixation with a bottom fixation created by a ring constructed from an inwardly extending flap, where the advancement of the lid into the thread makes the ring move beyond the encircling flange of the neck of the container, engaging the lid in permanent fashion.

The thread guarantees a fixation adapted to the neck of the container and the flap engaged by the flange of the neck allows a counterturning of the lid in the thread which, while turning in idle manner, thereby prevents an axial displacement of the lid.

Thus, the present invention provides a safety closure with lock, having a lid with a cap articulated by means of a hinge, characterized in that: the lid has a continuous lateral skirt with internal thread and a lower flap, forming a ring, and an external lateral grip, delimiting a slot; and the cap has, in a position diametrically opposite the hinge, an external flap, from which projects a lock body fitted into the slot of the retention flap, whose lock body has a central cutout forming a spring blade extending outwards from the lock body down to the lower level of the retention grip.

Preferably, the closure is made of a single piece with single wall. Also preferably, the lid has a top surface with a dispensing mouth and the cap has a sealing plug for the mouth. Also in a preferred embodiment, the lock of the cap and the external lateral grip of the lid are displaced diametrically from the hinge, and a manipulation tab is provided.

The invention also provides a system of attachment of the safety closure, characterized in that it allows the lid applied in a threaded neck provided with an encircling flange to turn idly in the unscrewing direction without allowing its axial displacement and removal.

In a preferred embodiment, the system of attachment of the safety closure comprises a lid having an internal thread with continuous lateral skirt and inwardly extending lower flap, applied in a threaded neck of a container having an encircling flange, such that the inwardly extending flap goes beyond the flange of the neck.

BRIEF DESCRIPTION OF THE DRAWINGS

Merely as an illustration, the invention will be better understood from a description making reference to the figures of the enclosed drawings, where.

DETAILED DESCRIPTION

Figure 1:
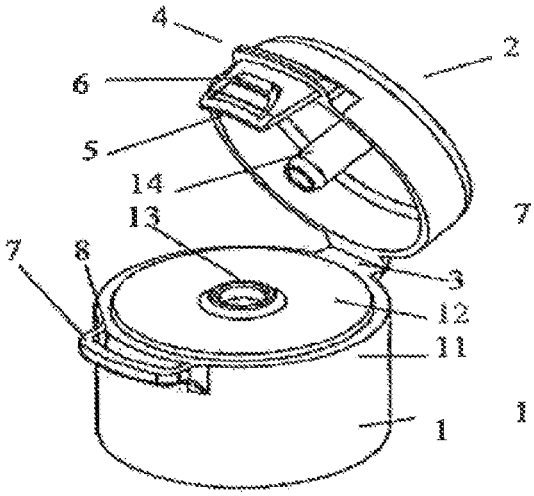
FIG. 1 is a perspective view of the closure according to the present invention with the cap open.
Figure 2:
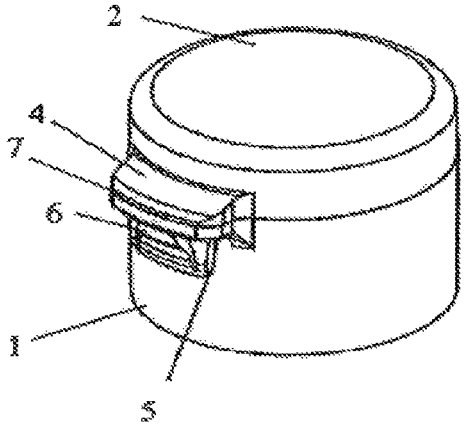
FIG. 2 is a perspective view of the closure according to the present invention with the cap closed.
Figure 3:
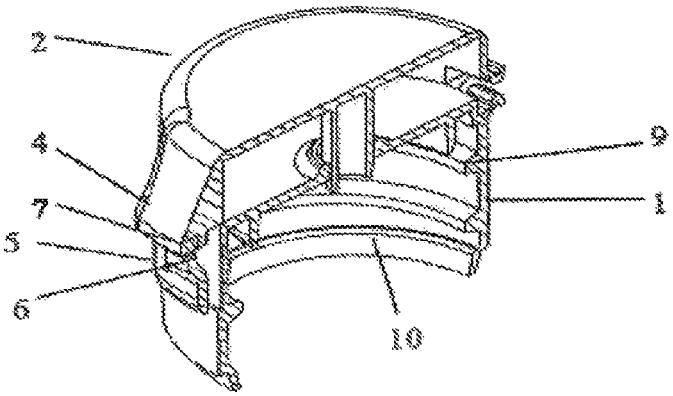
FIG. 3 is a cross section in perspective view of the closure according to the present invention with the lid locked and with an alternative design of the flap of the cap.
Figure 4:
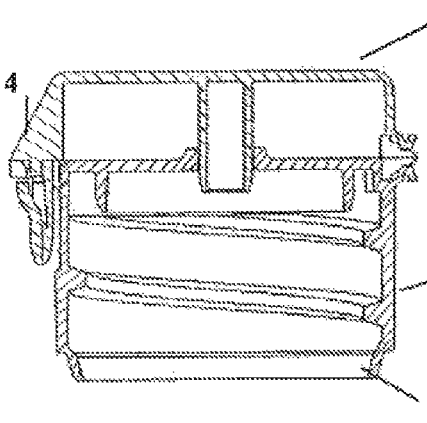
FIG. 4 is a cross section of the closure according to the present invention with the lower flap on the outside prior to application of the closure and with an alternative design of the flap of the cap.
Figure 5:
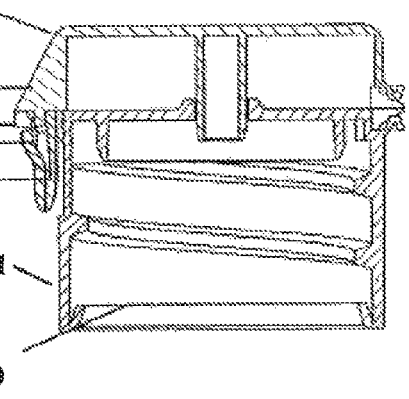
FIG. 5 is a cross section of the closure according to the present invention with the lower flap extending inwards.
Figure 6:
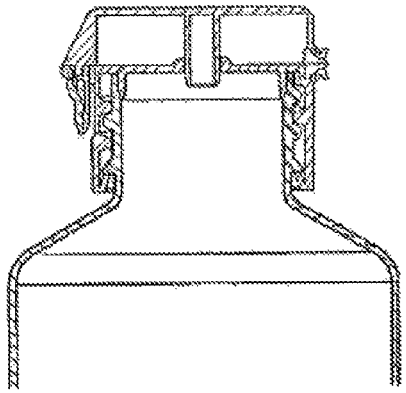
FIG. 6 is a cross section of the closure according to the present invention applied in the neck of a container.

As emerges from FIGS. 1 to 6, the child-resistant closure is comprised of a lid 1 and a cap 2, interconnected by a hinge 3, preferably made as a single piece, and with single wall.

The lid 1 has a lateral skirt 11, a top surface 12 with a pouring opening 13 and an external lateral grip 7, delimiting a slot 8 for engaging with the lock provided on the cap 2.

The continuous lateral skirt 11 has an internal thread 9 and, at the lower edge, a flap 10 or ring, responsible for the attachment of the lid in the neck of a container. The inwardly extending flap 10 checks the lid 1 against axial displacement caused by turning in the direction of unscrewing of the lid.

The cap 2 has a closure plug 14 for the pouring opening 13 and an external flap 4, from which a lock body 5 projects, with a central cutout forming a spring blade 6, extending outward from the lock body 5.

Since the releasing of the cap does not require displacement of the lock body 5, the slot 8 can have sufficient size for just inserting of the lock body, with no play.

The system of attachment of the lid 1 of the safety closure to the neck is characterized in that the lid with internal thread 9 and a lower flap 10 is inserted into the threaded neck, provided with an encircling flange, and allowing an idle turning in the direction of unscrewing without allowing the axial displacement for removal of the lid 1.

The lid 1 with its continuous lateral skirt 11 with internal thread 9 is inserted into the neck so that the inwardly extending lower flap 10 goes beyond the encircling flange existing on the neck of the container.

Figure 7:
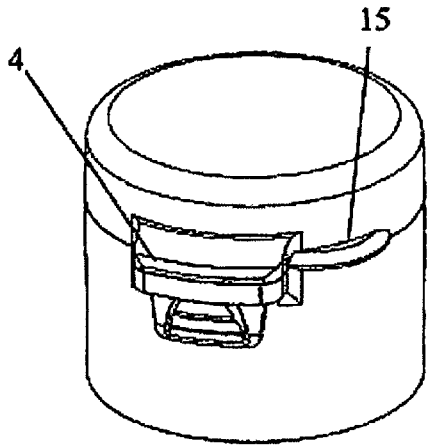
FIG. 7 is a perspective view of an alternative design of the closure according to the present invention with the cap closed.
Figure 8:
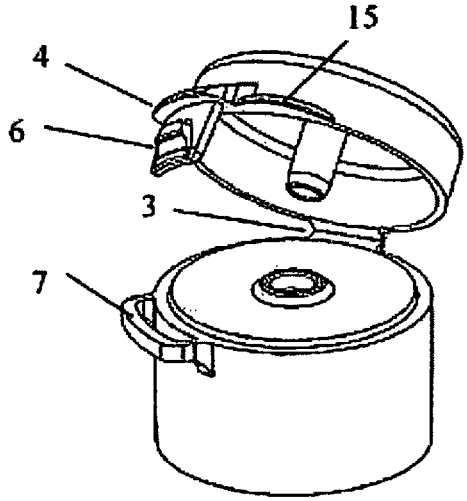
FIG. 8 is a perspective view of an alternative design of the closure according to the present invention with the cap open.

FIGS. 7 and 8 present an alternative design where the lock 5 of the cap and the external lateral grip 7 of the lid are displaced diametrically from the hinge 3 and a manipulating flap 15 is provided.

The invention claimed is:

1. A safety closure including a lock, comprising:

a lid and a cap interconnected by a hinge, the lid having a continuous lateral skirt with an internal thread and a lower flap forming a ring, and an external lateral grip delimiting a slot; and the cap having, in a position diametrically opposite the hinge, an external flap from which projects a lock body configured for engagement within the slot of the external lateral grip, the lock body including a central cutout forming a spring blade extending outwards from the lock body, the central cutout configured to extend through the external lateral grip down to a lower level of the external lateral grip upon engagement of the lock body within the slot.

2. The safety closure in accordance with claim 1, wherein the safety closure is a single piece with a single wall.

3. The safety closure in accordance with claim 1, wherein the lid has a top surface with a dispensing mouth and the cap has a sealing plug configured to receive the dispensing mouth.

4. The safety closure in accordance with claim 1, wherein the lock body of the cap and the external lateral grip of the lid are displaced diametrically from the hinge.

5. The safety closure in accordance with claim 4, wherein a manipulation tab is provided on the cap adjacent the lock body.

* * * * *